United States Patent [19]

Lau

[11] Patent Number: 4,617,493

[45] Date of Patent: Oct. 14, 1986

[54] COLLECTIVE INTERACTION KLYSTRON

[75] Inventor: Yue-Ying Lau, Silver Spring, Md.

[73] Assignee: United States of America as represented by the Secretary of the Navy, Washington, D.C.

[21] Appl. No.: 695,327

[22] Filed: Jan. 28, 1985

[51] Int. Cl.[4] ..... H01J 25/02

[52] U.S. Cl. ..... 315/5; 315/3; 315/5.39; 315/5.52; 372/2; 331/94.1

[58] Field of Search ..... 315/3, 4, 5, 5.39, 5.52; 372/2; 331/94.1

[56] References Cited

U.S. PATENT DOCUMENTS

| | | | |
|---|---|---|---|
| 3,153,742 | 10/1964 | Kluver | 315/3 |
| 3,258,702 | 6/1966 | Hart | 315/3 |
| 3,398,376 | 8/1968 | Hirshfield | 315/5 |
| 3,463,959 | 8/1969 | Jory et al. | 315/5 |
| 3,879,679 | 4/1975 | Mourier | 372/2 |

*Primary Examiner*—Saxfield Chatmon

*Attorney, Agent, or Firm*—Robert F. Beers; Sol Sheinbein; Ansel M. Schwartz

[57] ABSTRACT

A collective interactive klystron that utilizes a bent drift tube to achieve circular motions of the electrons in the drift region. This bent drift tube eliminates material repulsion between AC space charges in a klystron.

20 Claims, 2 Drawing Figures

COLLECTIVE INTERACTION KLYSTRON

BACKGROUND OF THE INVENTION

The klystron may be regarded as the most highly developed among conventional microwave tubes. It has a wide range of applications, from communication transmission at low power levels to high-energy particle acceleration where tens of megawatts are required. The simplest (though not necessarily the most practical) klystron configuration consists of two cavities separated by a linear drift region. See M. Chodorow and C. Susskind, Fundamentals of Microwave Electronics (McGraw-Hill, New York, 1964), J. W. Gewartowski and H. A. Watson, Principles of Electron Tubes (Von Nostrand, New York, 1965). The input signal is injected into first cavity to provide a velocity modulation of the electrron beam. This velocity modulation, after being carried through the drift region, becomes a density modulation near the second cavity where the output power is extracted. Because of the mutual Coulombic repulsion among the ac space charges, the charge bunching near the output cavity cannot reach the level expected from kinematic (ballistic) considerations. In fact, the efficiency of the klystron depends sensitively on the grouping of electrons near the output cavity. See A. Staprans, E. W. McCume, and J. A. Ruetz, Proc. IEEE 61, 299 (1973).

One approach to compensate for the mutual Coulombic repulsion among the ac space charges has been to develop multicavity klystrons. The effect of each cavity is to reinforce the correct modulation, thus offsetting somewhat the mutual Coulombic repulsion effect. However, the addition of intermediate cavities would make the device bulky and costly. See C. Bastiens, G. Fallon, and M. Simon, Extremely High Power Klystrons for particle accelerations, IEEE Int'l Electron Devices Meeting, Technical Digest, PP. 190–194, Dec. 1982, and Staprans, E. W. Meume and J. A. Ruetz, supra.

The gyrotron-klystron (gyroklystron) has received some attention in the past. However, development of the gyrotron-klystron so far has been quite disappointing and there appears to be little recent activity. It lags far behind the gyrotron oscillators or the gyrotron traveling wave amplifiers. Such a state of affairs is in sharp contrast to conventional microwave sources. See H. R. Jory, Gyro-Device developments and applications. IEEE Int'l Electron Devices Meeting, Technical Digest, PP. 182–185, Dec. 1981.

The most impressive result is a gyroklystron reported by the Soviets to have 70% efficiency. Unfortunately no other information, other than a brief reference to this achievement, is available in the literature about this device. See H. R. Jory, supra. A gyroklystron amplifier at Varian Assoc. in California, produced 50 kW pulsed output at 28 GHz with gain of 40 dB and efficiency of 9%. Calculations predicted a power output of 280 kW with efficiency of 44%. The poor agreement was thought to be caused by velocity spread and space charge effects in the beam. Calculations predict a useful maximum bandwidth for the gyroklystron of about 1%. See H. R. Jory, supra.

SUMMARY OF THE INVENTION

Accordingly, one object of this invention is to provide a novel device that eliminates the mutual coulombic repulsion among ac space charges in a klystron.

Another object of this invention is to provide a novel klystron that has a curved drift tube.

Another object of this invention is to provide a klystron that has an output rf current proportionally approaching 1.16 to where Io is the initial beam current, independent of the current level.

Yet another object of this invention is to provide a novel klystron which is efficient, compact and capable of yielding a high gain.

These and other objects of the present invention are achieved with a klystron comprising: a curved drift tube; said drift tube having a center of curvature, an input end and an output end; at least one input cavity located at the input end of said drift tube; an output cavity located at the output end of said drift tube; and means for having electrons which enter said drift tube follow a curved path defined by the shape of the drift tube.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
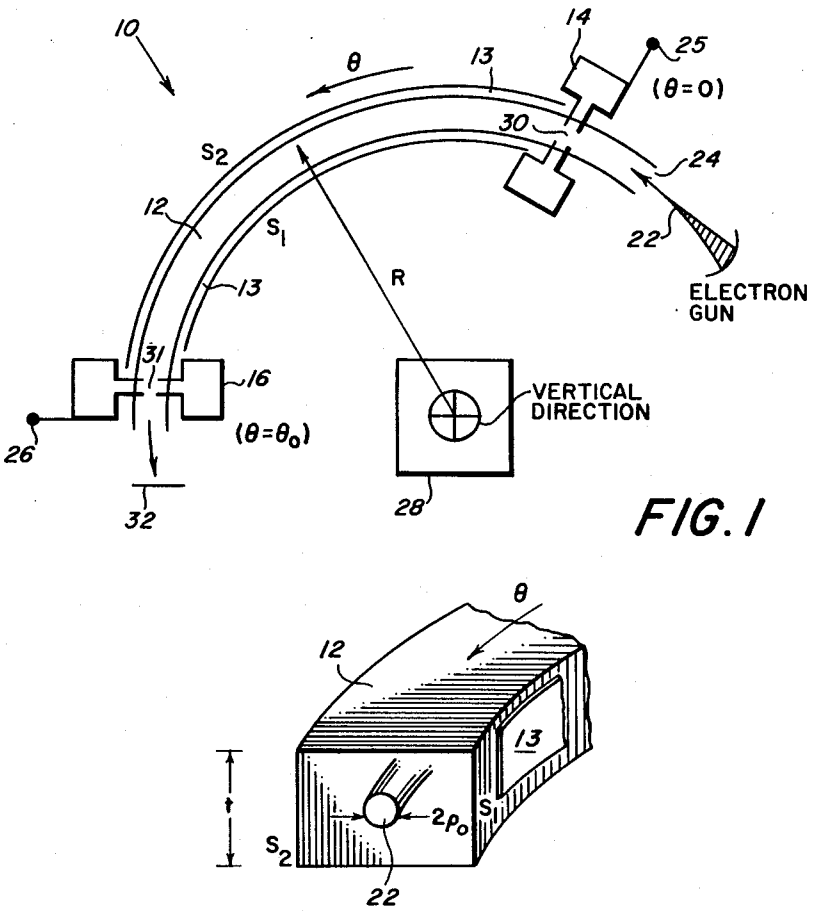
FIG. 1 is a schematic drawing of the collective interaction klystron and a cross-sectional view of its drift tube.

Referring now to the drawings, wherein like reference numerals designate identical or corresponding parts throughout the several views, and more particularly to FIG. 1 thereof, a collective-interaction Kystron 10 is known. The Klystron 10 is comprised of a drift tube 12 that is bent into a circular arc length of a circle and has an input cavity 14 and an output cavity 16 disposed at opposite ends thereof. Input cavity 14 has a coupler or coaxial cable 25 to introduce an RF signal into the cavity 14. An output cavity 16 is coupled to a load by means of a waveguide 26.

In the operation of the klystron, an electron beam 22 is introduced into klystron end 24. The electron beam 22 can be produced from e.g. a Pierce gun, See Pierce, Jr. (1954), The Theory and Design of Electron Beams, Van Nostrand, Princeton, N.J. When the electron beam 22 passes through the input cavity 14, the ac electric field across an input cavity gap 30 of input cavity 14 due to an inputed RF signal via coupler 25 causes the electrons in the electron beam to either speed up or slow down depending on the phase of the cavity 14 at the time an electron of the beam 22 is passing through the gap voltage gap 30. When the gap voltage is in phase with the electron beam, the electron slows down. When the gap voltage is 180 degrees out of phase, the electron speeds up. A velocity modulation is thus imparted upon the electron beam by the rf input signal when the beam leaves the input gap 30.

The presence of a velocity modulation necessarily produces a density modulation in the beam as the beam electrons traverse the drift tube 12, since the electrons, which have been sped up by the rf voltage at the input gap 30, will catch up with the electrons ahead of them, whereas those slowed down will be overtaken by the subsequent ones. However, by bending the drift tube into a circular area, the density modulation builds up its intensity progressively in the ($\theta$) direction of the drift tube 12. As we shall see below, this is the crucial feature of the present invention which distinguishes it from the conventional klystrons which employ only a straight drift tube. Of course, for an electron to follow the circular path of the drift tube 12, a radial electric field, or a vertical magnetic field pointing out of the plane of the paper, or a combination of the two, must be provided. The specification will be provided later, after the following description of the principle underlying the advantage of a curved drift tube. The following analysis is supplemented by two examples demonstrating the procedures of choosing the design parameters.

It is now shown that by bending the drift tube into a circular arc, the grouping of the ac space charges i.e. the electrons, is greatly enhanced. This is possible because of the rather powerful "negative mass" effects in rotating electron beams, where the ac space charges tend to accumulate instead of self-dispersing. See C. E. Nielson, A. M. Sessler, and K. R. Symon, in Proceedings of the International Conference on Accelerators (CERN, Geneva, 1959), PP. 239; also A. A. Kolomenski and A. N. Lebedev, bid, PP. 115. Consider first the case where the rotation of the electron beam in the drift tube 12 is supported by a dc magnetic field B pointing out of the plane of the paper. Essentially, the reason for the accumulation of electrons rather than the dispersion of electrons due to like-charge repulsion can be understood by referring to the equation describing the angular velocity, $W_o$, of an electron in the circular drift tube:

$$W_o = \frac{|e|B}{M_o\gamma},$$

ps where $|e|$ is the magnitude of the value of the charge of the electron, B is the magnetic field that controls the path of the electron, Mo is the rest mass of the electron, $$\gamma = 1/\sqrt{1 - V^2/c^2},$$

is the relativistic factor wherein V is the linear velocity of the electron at a given time and C is the speed of light in a vacuum. Thus, an electron ahead of a density bunch (modulation) is accelerated by the like charges in the bunch. This electron is sped up and its energy ($\gamma$) increases. But $\gamma$ is in the denominator of the equation for Wo resulting in Wo decreasing for this electron. This means that this electron, which is originally ahead of the bunch, falls back toward the bunch as it travels along the drift tube. There the density modulation increases progressively along the direction of the drift tube. This phenomena of charge build-up was first noticed in high energy circular accelerators. See Neilson et al. supra, Kolomenski et al. supra.

The present device is, therefore, distinguished from the conventional klystron in that the collective motions strengthen rather than weaken the density electron. As mentioned above, for the electron beam to follow a circular arc in the drift section, radial force must be externally supplied. This can be achieved via a vertical magnetic field, or preferably in the case of low beam energy, via a radial dc electric field as shown in FIG. 1. While the above description for the negative mass behavior is given for the case of a magnetic field, it can also be applied when a radial electric field is used. See Lau and Chernin, Phys. Rev. Lett. 52, 1425 (1984) Chernin and Lau, Phys. Fluids 27, 2319 (1984). In fact, the use of a dc electric field is quite important for it can cover the range of beam energies in which gyrotrons cease to be operational. For gyrotrons to function, the electron beam energy must be sufficiently large for the relativistic mass correction (which is crucial for gyrotron operations) to become appreciable. See Sprangle and Drobot, IEEE Trans. Microwave Theory and Tech. 25, 528 (1977); Lau, IEEE Trans. Electron Devices, 29, 320 (1982). The magnetic field B can be achieved with a permanent magnet or conventional electromagnet 28 situated so that the magnetic field causes the electron to follow a circular path through the drift tube. A radial dc electric field can be produced by a voltage supply, charging plates 13 which are placed on opposite sides $S_1$ and $S_2$ of drift tube 12, lining the length of the respective drift tube walls.

An elementary analysis of the phenomena in the klystron can be found in Chodorow and Susskind, supra; and Glewartowski and Watson, supra. By taking into account the negative-mass mechanism the analysis can be modified to be the following.

In the absence of the rf modulation, the electron beam is assumed to move along the circular arc of the drift tube 12 at linear velocity $\vec{V}_o = \hat{\theta}V_o(r) \equiv \hat{\theta}r\omega_o(r)$, where r is the radial distance from the center of curvature of the circular arc and $\theta$ is the angular variable along the drift tube (FIG. 1). At this point in the analysis the relative strength of the radial electric field $E_o$ and the vertical magnetic field $B_o$ which are needed to provide the circular motion of the beam are left unspecified. Thus, $V_o$ is governed by $$\gamma_o V_o^2/r = -(e/m_o)(E_o + V_o B_o), \quad (1)$$

where e and $m_o$ are, respectively, the electron charge and rest mass, and $\gamma_o = (1 - V_o^2/c^{2\frac{1}{2}})$ is the relativistic mass factor with c being the speed of light. In writing (1), the dc self-fields of the electrons have been ignored for simplicity. The beam is assumed to be monoenergetic, have a small beam cross section, and be located at mean radius r=R with number density N per unit arc length along the drift tube. Associated with the velocity modulation is a longitudinal ac displacement $\eta$ of an electron from its unperturbed orbit. Similar to plasma oscillation, this displacement leads to a charge perturbation which then generates an ac self-electric-field $E_{1\theta}$. In response to this ac electric field $E_{1\theta}$, the angular displacement $\eta$ of an electron obeys the following linearized force law $$\ddot{\eta} = \Gamma V_o \left(\frac{\partial \omega_o}{\partial \epsilon}\right) eE_{1\theta} \quad (2)$$

Here a dot denotes the substantial derivative, $\epsilon$ is the total energy of the electron, and $\partial\omega_o/\partial\epsilon$ is the negative-mass factor. For an equilibrium governed by Eq. (1), $\partial\omega_o/\partial\epsilon$ is given by $$\frac{\partial\omega_o}{\partial\epsilon} = -\frac{1}{\Gamma M_o\gamma_o V_c}\left[\frac{\beta_o^2 + 2h}{1 + \gamma_o^2 h^2}\right] \tag{3}$$

where $$h = -erE_o/M_o\gamma_o^3 V_o^2 \tag{4}$$

and $$\beta_o \equiv Vo/c \equiv PW_o/c.$$

The negative-mass behavior arises if the frequency of rotation $\omega_o$ is a decreasing function of energy ($\partial\omega_o/\partial\epsilon<0$). In this case, the angular acceleration is opposite to the applied force $eE_{1\theta}$, as if the inertia of the electron is negative. See C. E. Nelson, A. M. Sessler, and K. R. Symon, Proceedings of the Int'l Conference on Accelerators (CERN, Geneva, 1959), P. 239; A. A. Kolomeskii and A. N. Lebedev, p. 115, V. K. Neil and W. Heckrotte, J. Appl. Phys. 76,2761 (1965); R. W. Landau and V. K. Neil, Phys. Fluids 9, 2412 (1968); R. J. Briggs and V. K. Neil, J. Nucl. Energy 9, 209, (1967). Y. Y. Lau and D. Chernin, Phys. Rev. Lett. 52, 1425 (1984); D. Chernin and Y. Y. Lau, Phys. Fluids 27, 2319 (1984). There would then be an intrinsic tendency of beam bunching, as qualitatively described above. if the rotation of the electron is supported solely by a magnetic field, $E_o=0$ and therefore $h=0$ by (4). Equations (2) and (3) then yield $\eta=-\beta_o eE_{1\theta}/\gamma_o M_o$ which clearly shows the negative-mass nature of a rotating electron, under a uniform magnetic field, as a result of the relativistic mass correction ($c\neq\infty$). A new class of microwave generation devices, known as the gyrotron, has been developed based on this principle. See e.g. V. L. Granatstein, M. E. Read and L. R. Barnett Infrared and Millimeter Waves, edited by K. J. Button (Academic, N.Y. 1982), Vol. 5, p. 267 and references therein; Y. Y. Lau, IEEE Trans. Electron Devices 29, 320(1982), and 31, 329(1984).

Another limiting case is when $h=1/\gamma_o^2$, i.e., when the rotation of the electron is supported solely by an outward radial electric field [cf. Eqs. (1) and (4)]. In this case, $\partial\omega_o/\partial\epsilon<0$ also. This is precisely the equilibrium condition in the microwave generation experiment of Alexeff and Dyer, Phys. Rev. Lett. 43, 351(1980). In fact, one may easily demonstrate from (3) that $\partial\omega_o/\partial\epsilon$ is maximized with respect to h when $h=1/\gamma_o^2$. Thus, among all possible combinations of $E_0$ and $B_o$, the negative-mass effect is most pronounced, see Y. Y. Lau and C. Chernin, Phys. Rev. Lett. 52, 1425(1984), when the rotation of the electron is supported just by a radial electric field [cf. Eqs. (3) and (4)] for a given beam energy and given beam radius R. One may compare the negative-mass effects for $h=0$ and for $h=1/\gamma_o^2$ through the relation $$\left.\frac{\partial\omega_o}{\partial\epsilon}\right|_{h=\frac{1}{\gamma_o^2}} = \frac{1}{\beta_o^2}\left.\frac{\partial\omega_o}{\partial\epsilon}\right|_{h=o} \tag{5}$$

which is readily deduced from Eq. (3). Equation (5) clearly suggests the advantage of using only a radial dc electric field ($h=1/\gamma_o^2$) at low beam voltage (low $\beta_o$). At a high beam voltage, a vertical magnetic field suffices.

A signal of frequency $\omega$ impressed upon the rotating electron beam yields an angular variation proportional to $\exp(-il\theta)$, where $l=\omega/\omega_o$. Note that l may be regarded as a propagation constant and that it is not necessarily an integer in the present case. Such an angular variation in the displacement $\eta$ produces ac space charges whose number density $N_l$ per unit arc length is $$N_l = \frac{N}{R}\frac{d\eta}{d\theta} = \frac{iNl\eta}{R} \tag{6}$$

This ac line charge yields a self-electric-field $E_{1\theta}$ at the beam:

$$E_{1\theta} = \frac{ilgeN_l}{R4\pi\epsilon_o} = -\frac{l^2geN\eta}{R^2 4\pi\epsilon_o} \tag{7}$$

where $\epsilon_o$ is the free-space permittivity (MKS units) and g is essentially the dimensionless impedance experienced by the beam and is given by $$g \cong [1+2\ln(2t/\pi\rho_o)]\gamma_o^2 \tag{8}$$

for the dimension specified in FIG. 1.

Upon substituting Eq. (7) into Eq. (2), the result is $$\ddot{\eta} - \Gamma\eta = 0 \tag{9}$$

where $$\Gamma^2 = g\frac{l^2c^2P}{R^2\gamma_o}\left[\frac{\beta_o^2 + 2h}{1 + \gamma_o^2 h^2}\right] \tag{10}$$

with $P=Ne^2/4\pi\epsilon_o M_o C^2$ being the dimensionless Budker parameter. Note that $\Gamma$ is essentially the rate of growth of the negative-mass instability in a rotating relativistic electron beam. Equation (9) has its counterpart in the conventional klystron theory in which $-\Gamma^2$ is replaced by $\omega_p^2$, $\omega_p$ being the electron plasma frequency.

To calculate the fundamental harmonic of the ac current at the output gap consider an electron leaving the input gap at $\theta=0$ (FIG. 1) at time $t=t_1$, with a velocity modulation $\eta(t_1)=(\alpha V_o/2)\sin(\omega t_1)$, where $\alpha$ is the modulation depth. See Chodorow and Susskind, supra; Gewartowski and Watson, supra. Then Eq. (9) gives $$\eta(+) = (\alpha V_o/2\Gamma)\sin(\omega t_1)\mathrm{Sinh}[\Gamma(t-t_1)] \tag{11}$$

if it is assumed that $\eta(t_1)=0$. Equation (11) may be used to transform from the Lagrangian to the Eulerian variables at $\theta=\theta_o$, the angular position of the output cavity (FIG. 1). From the definition of $\eta$ the electron arrives at $\theta=\theta_o$ at time $t=T$, where $\theta_o$ and T are related by $$\theta(t) \equiv \theta_o = W_o(T - t_1) + \eta(t)/R$$

$$= W_o(T - t_1) + \frac{\gamma W_o}{2\Gamma}\sin(\text{wt.})\sinh[\Gamma(T - t_1)].$$

This relation may be inverted to yield $$T \simeq t_1 + \frac{\theta_o}{\omega_o} - \frac{\alpha}{2\Gamma} \operatorname{Sin}(\omega t_1)\operatorname{Sinh}\left[\frac{\Gamma\theta_o}{\omega_o}\right], \tag{12}$$

in the small-signal theory (small $\alpha$). The rf current $I_2(\theta_o, T)$ at the output gap contains all harmonic frequencies and may be represented in Fourier series as $$I_2(\theta_o, T) = \sum_{n=-\infty}^{\infty} [Q_n(\theta_o)\cos(n\omega t) + b_n(\theta_o)\sin(n\omega T)].$$

The Fourier coefficient is given by $$Q_n(\theta_o) = \omega/2\pi \times \left[\int_{-\pi/\omega}^{\pi/\omega} dT I_2(\theta_o T)\cos(n\omega T) = \frac{\omega I_o}{2\pi}\int_{-\pi/\omega}^{\pi/\omega} dt_1 \cos(n\omega T),\right. \tag{13}$$

where $I_o$ is the dc current carried by the beam at the input gap. In writing the last expression, the charge-conservation relation $I_2 dT = I_o dt_1$ has been used. Upon substituting (12) into (13), $a_n(\theta_o)$ is obtained [and a similar expression for $b_n(\theta_o)$]. The total current $I_2$ at the output gap is $$I_2(\theta_o, T) = I_o + \sum_{n=1}^{\infty} 2I_o J_n(X_n) \times \cos[n\omega(\Gamma - \theta_o/\omega_o)]; \tag{14}$$

where $X_n = (n\alpha\omega/2\Gamma)\sinh(\Gamma\theta_o/\omega o)$ and $J_n$ is the Bessel function of the first kind, of order n.

Figure 2:
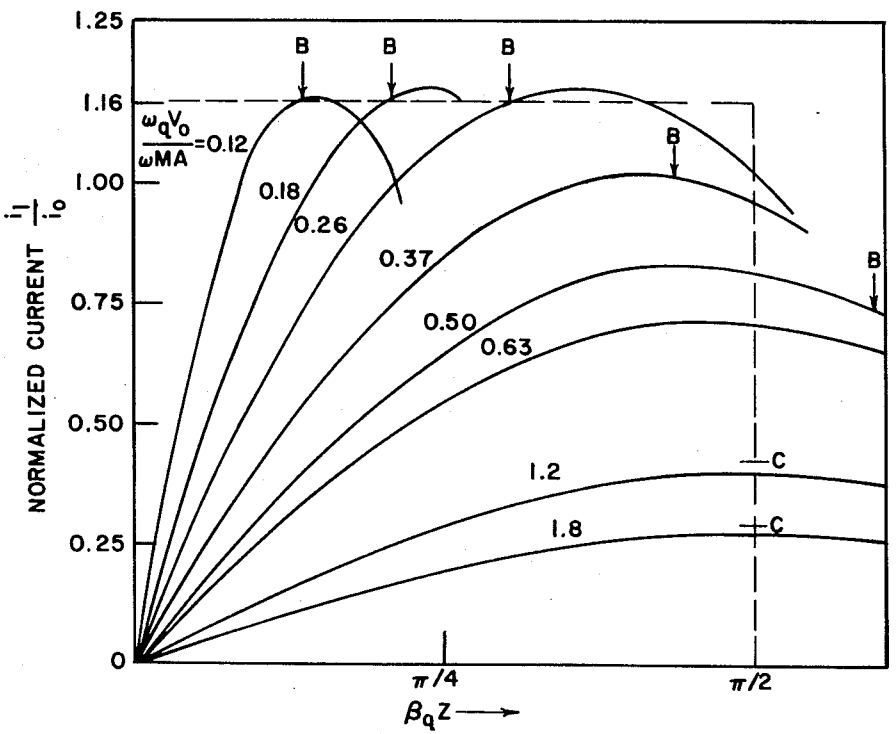
FIG. 2 is a graph, attached here for the benefit of comparison, of the variation of the fundamental component of the convection current with distance from the input gap of the drift, for a conventional two cavity klystron with a straight drift tube.

Equation (14) has a similar structure as the corresponding one for conventional klystron. As a check, it should be note that in the limit of zero density, $\Gamma \rightarrow 0$ by (10) and the collective effect disappears. In this limit, (14) indeed agrees with the classical result where only ballistic bunching is present. The negative-mass effect may be examined by considering just the fundamental harmonic $2I_oJ_1(X_1)$ in the output current $I_2$ and the output cavity should be designed to resonant accordingly. See Gewartowski and Watson, supra. The peak value of this quantity is $1.16I_o$, occurring at $X_1 = 1.841$. Since $$X_1 = (\alpha\omega/2\Gamma)\sinh(\Gamma\theta_o/\omega_o), \tag{15}$$

a very small velocity modulation at the input gap may yield the maximum achieveable rf current $1.16I_o$ at the output gap if $\Gamma\theta_o/\omega_o$ is sufficiently large. This is quite different from the conventional klystron, and is due to the enhanced charge bunching resulting from the negative-mass effect associated with a bent drift tube. In contrast, a weak modulation at the input gap of a convensional two-cavity klystron is unable to achieve this peak value of current bunching because of the Coulombic repulsion among the ac space charges. See FIG. 2, where it is shown in this figure that the ac-space-charge effects, in a conventional two-cavity klystron with a straight drift tube, limit the rf current to $0.25I_o$ (or less) if the input signal is sufficiently weak. This rf current is significantly less than $1.16I_o$. More specifically FIG. 2 is a variation of the magnitude of the fundamental component of the convection current with distance from the input gap, as given by computer calculations when the drift tube is straight. For a beam of fixed voltage and current, the different curves represent operation at different input signal voltages, A. The nonlinear theory, neglecting space charge, predicts a nonvarying maximum value of $1.16I_o$ occurring at values of the abscissa marked B for five of the curves. The small-signal, space-charge theory predicts maxima as given by levels marked C for two of the curves, occurring at a fixed distance given by one quarter of a reduced plasma wavelength. See Gerwartowskii and Watson, supra.

Two examples are now given. For low voltage operation, take $\theta_o = 2\pi/3$, R=4 cm, $\beta_o = 0.1389$, corresponding to a beam energy of 5 KeV. Then $\omega_o 2\pi = \beta_o c/2\pi R = 0.1658$ GHz. Then Eq. (10) yields $\Gamma/\omega_o = 1.86$ for g=4, $h = 1/\gamma_o^2$, and a beam current of 0.1 A. For these parameters, the maximum achieveable rf current (according to the present linear theory) may be attained at the output cavity if the modulation factor $\alpha$ is as low as 0.014. In this example, a radial electric field $E_o = 2.5$ keV/cm is used to prevent the circular motion in the drift tube.

For high-voltage operation, consider, for example, a beam at a voltage of 300 keV and a current of 160 A. For R=22.36 cm, $\theta_o = 100°$, h=0, $g \simeq 1.59$, $\omega/\omega_o = 20$ (i.e., operation at 3.32 GHz), saturation occurs when $\alpha = 0.0174$. Here, only a vertical magnetic field $B_o = 94G$ is used to provide the circular motion in the drift tube. The estimated efficiencies for both examples are close to 60 percent.

The above analysis established that the maximum rf current of $1.16I_o$ may be reached if the drift tube is bent. This maximum bunching should occur approximately at the gap 31 of the output cavity 16. Equation (15) above determines the desired angular position ($\theta_o$) of the output cavity 16. As in the case of the conventional klystron tube, this rf beam current excites the output cavity 16, thereby yielding an rf voltage across the output gap 31. If the phase of the output gap voltage is maintained in such a way that the bunched electrons encounter a decelerating phase, the beam yields its kinetic energy to the field of the output cavity. When the electrons emerge from the output gap 16, they have reduced velocity and are collected at the collector 32.

Except for the bending of the drift tube and the electric or magnetic means to bend the orbits of the electrons inside the drift tube as specified above, for all intents and purposes, the input cavity, the output cavity, the means to couple the rf energy into (and out of) these cavities, and the electron source may be the same in dimension and material, as in the conventional klystroms, at the corresponding parameters in beam voltage, beam current, and the frequencies of the signal.

Obviously, numerous (additional) modifications and variations of the present invention are possible in light of the above teachings. For example, a solonoidal magnetic field may be used to focus the beam and a depressed collector may be used for energy recovery if still higher efficiency is desired. These are well-known procedures in the practices of microwave tubes. It is therefore to be understood that within the scope of the appended claims, the invention may be practiced otherwise than as specifically described herein.

What is claimed as new and desired to be secured by Letters Patent of the United States is:

1. A klystron comprising:

a curved drift tube which is curved sufficiently to induce the negative mass effect; said drift tube having a center of curvature, an arc length, an input end and an output end;

at least one input cavity located at the input end of said drift tube;

an output cavity located at the output end of said drift tube; and means for having electrons which enter said drift tube follow a curved path defined by the shape of the drift tube.

2. A klystron as described in claim 1 wherein said input cavity has an input coupling means for receiving RF waves and said output cavity has an output coupling means for emitting RF waves.

3. A klystron as described in claim 1 wherein the arc length and the radius of curvature of the drift tube is found according to the equation $$1.841 = \frac{\alpha W}{2\Gamma} \sinh(\Gamma\theta o/W_o),$$

where $\alpha$ is the modulation depth, $\omega$ is the frequency of an inputed RF signal, $\theta_o$ is the angle subtended by said input cavity and said output cavity, $\omega_o$ is the frequency of rotation and is defined by $V_o/R$ where $V_o$ is the initial velocity of an electron that enters said drift tube and R is the beam radius of curvature of the drift tube, and $\Gamma$ is the rate of growth of the negative-mass instability in a rotating relativistic electron beam and is defined by $$\Gamma^2 = g\frac{l^2c^2}{R^2}\ \frac{P}{\gamma_o}\left[\frac{\beta_o^2 + 2h}{1 + \gamma_o^2h^2}\right]$$

where l is a propagation constant defined by $\omega/\omega_o$, c is the speed of light in a vacuum, $\gamma_o$ is the relativistic mass factor defined by $(1-V_o^2/c2)^{-\frac{1}{2}}$, p is the dimensionless Budker parameter being defined as $p=Ne^2/4\pi\epsilon_oM_oC^2$ where N is the number of electrons per unit arc length, e is the electron charge, $M_o$ is the electron mass and $\epsilon_o$ is the permittivity of free space, $\beta_o=V_o/C=RW_o/C$, $h=-eRE_o/M_oV_o^3\gamma_o^3$ where $E_0$ is the value of radial electric field, and g is the dimensionless impedence experienced by an electron beam passing through the drift tube and is defined by $$g = [1 + 2\ln(2t/\pi\rho o)]/\gamma o^2$$

where t is the height of the drift tube and $\rho_o$ is the beam minor radius or cross-sectional radius.

4. A klystron as described in claim 1 wherein the curve following means is a vertical magnetic field.

5. A klystron as described in claim 3 wherein the curve following means is a vertical magnetic field.

6. A klystron as described in claim 1 wherein the curve following means is a radial dc electric field of curvature.

7. A klystron as described in claim 3 wherein the curve following means is a radial dc electric field of curvature.

8. A klystron as described in claim 1 wherein the curve following means is a vertical magnetic field and a radial dc electric field.

9. A klystron as described in claim 3 wherein the curve following means is a vertical magnetic field and a radial dc electric field.

10. A klystron as described in claim 4 wherein the vertical magnetic field is produced by a permanent magnet.

11. A klystron as described in claim 5 wherein the radial dc electric field is produced by a first conducting strip lining the said drift tube wall at a first constant radius from said center of curvature and a second conducting strip lining said drift tube wall at a second constant radius from said center of curvature.

12. A klystron as described in claim 6 wherein the vertical magnetic field is produced by a permanent magnet and the radial dc electric field is produced by a first conducting strip lining said drift tube wall at a first constant radius from said center of curvature and a second conducting strip lining said drift tube wall at a second constant radius from said center of curvature.

13. A klystron as described in claim 1 wherein the spent electron beam is terminated at a depressed collector.

14. A klystron as described in claim 3 wherein the spent electron beam is terminated at a depressed collector.

15. A method for increasing the strength of an RF signal comprising the steps of:

aiming an electron beam into an input end of a klystron which has a curved drift tube with a center of curvature and an arc length, and a curve following means which causes the electron beam to follow a path defined by the shape of the curved drift tube;

inputing an RF signal into the klystron through an input cavity of the klystron so the electron beam is modulated by the input cavity as it passes through a gap in the input cavity; and producing an output RF signal proportional to but stronger in amplitude than the inputed RF signal by means of an output cavity that resonates in response to a first or fundemental harmonic of the modulated electron beam as the electron beam passes through a gap in the output cavity.

16. A method as described in claim 11 wherein the curved drift tube has arc length and radius of curvature defined according to the equation $$1.841 = \frac{\alpha W}{2\Gamma} \sinh(\Gamma\theta o/W_o),$$

where $\alpha$ is the modulation depth, $\omega$ is the frequency of an inputed RF signal, $\theta o$ is the angle subtended by said input cavity and said output cavity, $\omega_o$ is the frequency of rotation and is defined by $V_o/R$ where $V_o$ is the initial velocity of an electron that enters said drift tube and R is the beam radius of curvature of the drift tube, and $\Gamma$ is the rate of growth of the negative-mass instability in a rotating relativistic electron beam and is defined by $$\Gamma^2 = g\frac{l^2c^2}{R^2}\ \frac{P}{\gamma_o}\left[\frac{\beta_o^2 + 2h}{1 + \gamma_o^2h^2}\right]$$

where l is a propagation constant defined by $\omega/\omega_o$, c is the speed of light in a vacuum, $\gamma_o$ is the relativistic mass factor defined by $(1-V_o^2/c2)^{-\frac{1}{2}}$, p is the dimensionless Budker parameter being defined as $p=Ne^2/4\pi\epsilon_oM_oC^2$ where N is the number of electrons per unit arc length, e is the electron charge, Mo is the electron/mass and $\epsilon_o$ is the permittivity of free space, $\beta_o=V_o/C=RW_o/C$, $h=-eRE_o/M_oV_o^3\gamma o^3$ where $E_o$ is the value of radial electric field, and g is the dimensionless inpedence experienced by an electron beam passing through the drift tube and is defined by $$g = [1 + 2\ln(2t/\pi\rho o)]/\gamma o^2$$

where t is the height of the drift tube and $\rho_o$ is the beam minor radius or cross-sectional radius.

17. A method as described in claim 15 wherein the curve following means is a radial electric field.

18. A method as described in claim 16 wherein the curve following means is a radial electric field.

19. A method as described in claim 15 wherein the curve following means is a vertical magnetic field.

20. A method as described in claim 16 wherein the curve following means is a vertical magnetic field.

* * * * *